United States Patent [19]

Woodford

[11] 3,976,013

[45] Aug. 24, 1976

[54] SHEET METAL PALLET

[76] Inventor: William H. Woodford, 206 Stephenson Court, Sheffield, Ala. 35660

[22] Filed: May 1, 1975

[21] Appl. No.: 573,402

[52] U.S. Cl. ..... 108/56.3; 52/629; 108/55.1; 248/188

[51] Int. Cl.[2] ..... B65D 19/28

[58] Field of Search ..... 108/51–58; 206/386; 248/151, 188, 188.8, 223; 52/483, 494, 629, 758 D, 669

[56] References Cited

UNITED STATES PATENTS

| | | | |
|---|---|---|---|
| 2,639,112 | 5/1953 | Cushman | 108/56 |
| 3,332,711 | 7/1967 | Holly | 52/758 D |
| 3,628,298 | 12/1971 | Sickler | 52/669 |

FOREIGN PATENTS OR APPLICATIONS

| | | | |
|---|---|---|---|
| 796,571 | 10/1968 | Canada | 108/51 |
| 290,444 | 3/1963 | Netherlands | 52/494 |

*Primary Examiner*—Roy D. Frazier
*Assistant Examiner*—William E. Lyddane

[57] ABSTRACT

A sheet metal pallet wherein the runners are attached to the deck by integral interrelating connections which obviate the need for welding, bolting or riveting.

5 Claims, 9 Drawing Figures

FIG-6
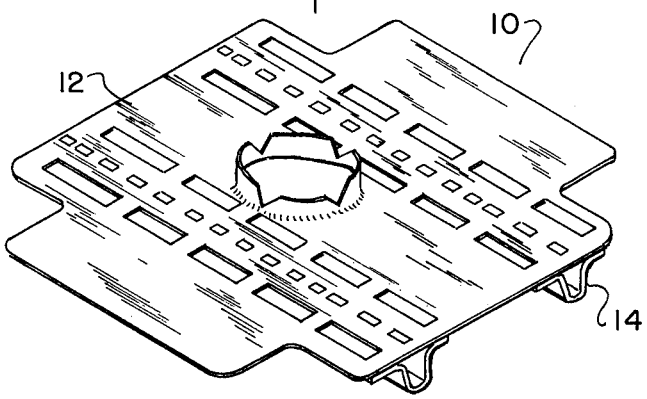
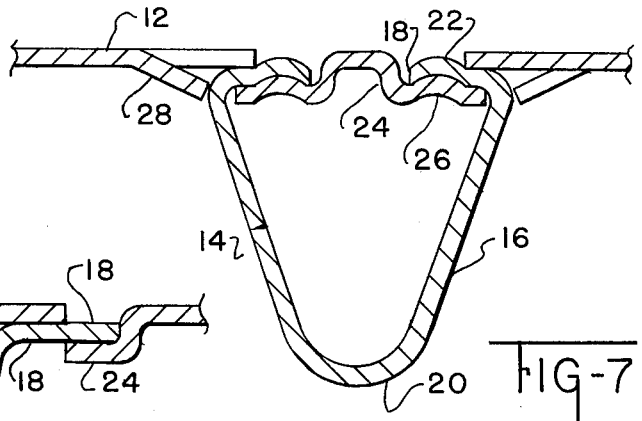
FIG-7
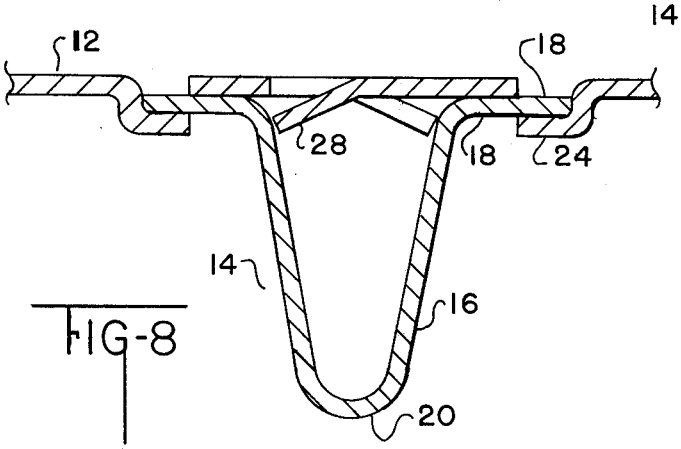
FIG-8
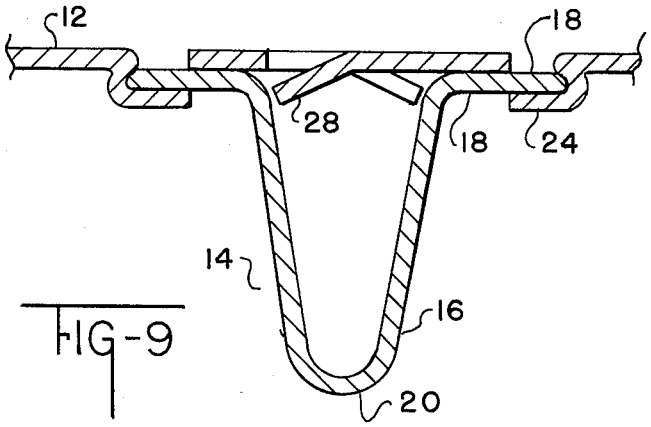
FIG-9

SHEET METAL PALLET

BACKGROUND

This invention broadly relates to pallets; in particular it relates to an improved sheet metal pallet.

For the purposes pertinent herein, a pallet is a portable platform for the handling, storage or movement of materials and packages in warehouses, factories or vehicles. Such pallets are typically characterized by a substantially planar load bearing deck supported slightly above the ground or other flat surface by a pair of runners.

Pallets with which the art has heretofore been familiar have been constructed of a variety of materials such as wood, cardboard and metal. More specifically pallets have been constructed of stamped sheet metal.

In one embodiment of a sheet metal pallet, a one piece construction is utilized, the runners being formed by metal drawn from the deck. One disadvantage of this type of pallet is that the deck material must be quite thick to provide for the runners and later withstand deformation under heavy loads. Consequently, fabrication has been recognized as difficult and expensive. See for example U.S. Pat. No. 3,120,825, issued Feb. 11, 1964 at column 1, lines 27–34.

In another sheet metal pallet embodiment, the deck and the runners are formed separately, assembly of the several parts being accomplished by welding, bolting or riveting. Although the material costs for this type of pallet are lower, fabrication is nevertheless expensive.

In accordance with the invention the mentioned prior disadvantages have been overcome by a sheet metal pallet characterized by separately formed components which are assembled without welding, bolting or riveting.

SUMMARY

The sheet metal pallet of the invention comprises at least one runner and a substantially planar deck. Each runner has a pair of integrally connected sidewalls, each sidewall having at least one flange which depends laterally from the uppermost portion thereof, the flanges being in coplanar relation. Each runner is positioned against the underside of the deck so that the flanges and the underside of the deck are in abutting relation.

The deck has a set of brackets which cooperates with the flanges to fix each runner to the deck. Each set of brackets includes at least one bracket for each flange, each bracket being displaced downwardly from the deck and integrally connected therewith, whereby in the deck there is defined an opening above each bracket. Each bracket has a laterally oriented surface portion and a substantially vertically oriented surface portion, the former surface portion being connected to the deck by the latter.

To resist normal displacement of each runner relative to the deck, the laterally oriented surface portion of each bracket is positioned immediately below the underside of the associated flange.

The pallet of the invention also includes means for resisting tangential displacement of each runner relative to the deck. In one embodiment the means includes the substantially vertically oriented surface portion of each bracket in position against the lengthwise edge of the associated flange.

According to a second embodiment the means includes a corrugated surface portion of each flange and a corrugated surface portion of each bracket. Each such flange portion has at least one downwardly open groove and each such bracket portion has an upwardly protruding ridge corresponding to at least one groove of the associated flange, each ridge being in tight interlocking relationship with the corresponding groove, the top surface portion of each flange which overlies the central portion of each groove therein being extended into the opening from which the associated bracket is displaced. ("Ridges" and "Grooves" herein refer generally to male and female mating surfaces and should, for example, be respectively read to include "nibs" and "dimples" or "teeth" and "notches".)

As should be apparent, the first and second abovementioned embodiments are not to be construed as being mutually exclusive; they may be resorted to alternatively or they may co-exist in combination.

The deck may also have a set of tabs which cooperates with the sidewalls so as to resist either angular or tangential displacement of each runner relative to the deck. Each set of tabs includes at least one tab for each sidewall of the associated runner, each tab being displaced downwardly from the deck and integrally connected therewith, each tab having a lower edge in proximate contact with the associated sidewall.

Other details, uses and advantages of the invention will become readily apparent from the exemplary embodiments thereof presented in the following specification, claims and drawings.

BRIEF DESCRIPTION OF THE DRAWINGS

FIG. 6 is a perspective view of an exemplary variation of the article of FIG. 1.

FIG. 7 is an exemplary transverse vertical sectional view of one embodiment of the pallet of the invention.

FIG. 8 is an exemplary transverse vertical sectional view of another embodiment of the pallet of the invention.

FIG. 9 is an exemplary transverse vertical sectional view of still another embodiment of the invention.

DETAILED DESCRIPTION OF THE INVENTION

Figure 1:
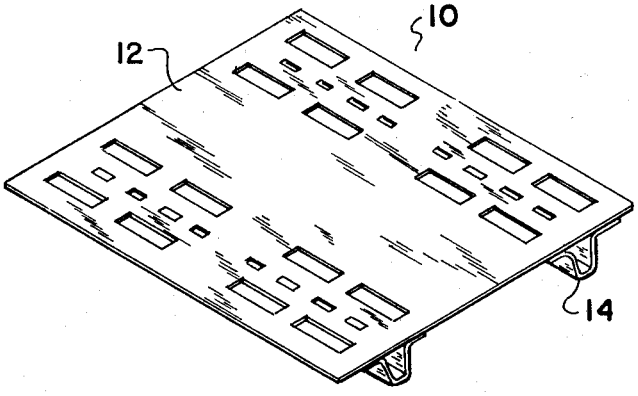
FIG. 1 is a perspective view of the presently preferred embodiment of the pallet of the invention.
Figure 2:
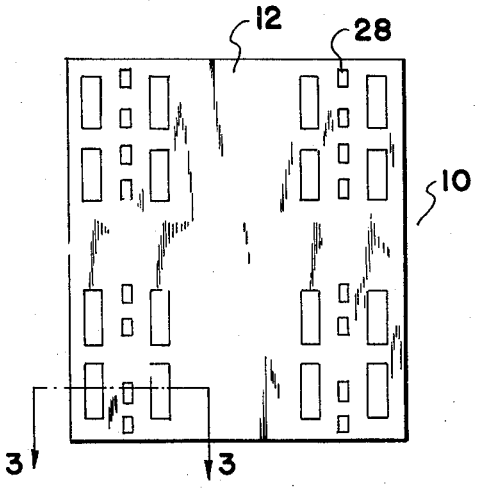
FIG. 2 is a top view of the article of FIG. 1.

For the presently preferred embodiment of the invention, reference is made generally to the first three figures of the drawings. FIG. 1 shows in perspective a pallet 10 which comprises a substantially planar deck, or deck 12, and a pair of runners 14. A top view of the embodiment appears in FIG. 2.

Figure 3:
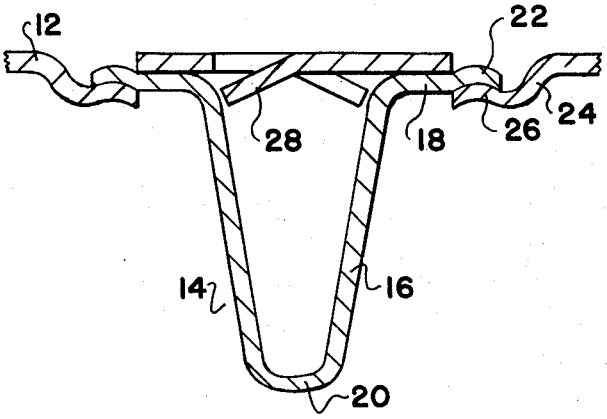
FIG. 3 is a transverse vertical sectional view taken along the line 3—3 of FIG. 2.

In FIG. 3 are shown details of a runner 14 and an exemplary portion of the deck 12. The runner 14 has a pair of integrally connected opposed sidewalls or sidewalls 16. Connecting the sidewalls 16 is a curved bottom surface or bottom 20, the direction of curvature being concave upwardly and the degree of curvature being such that the bottom 20 will become substantially flat when the deck 12 is fully loaded.

For purposes of stability, the sidewalls 16 preferably diverge upwardly from the bottom 20. It is believed that the illustrated curvature of the bottom 20 acts to mitigate the tendency of the sidewalls 16 to spread when under extreme load.

Each sidewall 16 has a flange 18 which depends outwardly from the uppermost portion thereof, the two flanges 18 being in coplanar relation. The runner 14 is positioned against the underside of the deck 12 so that the flanges 18 and the underside of the deck 12 are in abutting relation.

Each flange 18 has four corrugated surface portions each of which has one downwardly open groove, or groove 22, the significance of which is brought out below.

The deck 12 has a set of brackets which cooperates with the flanges 18 to fix the runner 14 to the deck 12. In the presently preferred embodiment the set of brackets consists of four brackets 24 for each flange 18, each bracket 24 being displaced downwardly from the deck 12 and integrally connected therewith, whereby in the deck 12 there is defined an opening above each bracket 24. Each bracket 24 has a corrugated surface portion which has an upwardly protruding ridge, or ridge 26, corresponding to one groove 22 of the associated flange 18. As shown in FIG. 3 bracket 24 is positioned immediately below the associated flange 18 such that each ridge 26 interlocks with the corresponding groove 22, and the top surface portion of each flange 18 which overlies the central portion of each groove therein is extended upwardly into the opening in the deck 12 from which the associated bracket 24 is displaced.

The deck 12 also has a set of tabs which cooperates with the two sidewalls 16 so as to resist displacement of the runner 14 with respect to the deck 12 such as when a torque is externally applied to the runner 14. The set of tabs consists of four tabs 28 for each sidewall 16, each tab 28 being displaced downwardly from the deck and integrally connected therewith and being located between the two sidewalls 16. The lower edge of each tab 28 is in proximate contact with the associated sidewall 16.

Figure 4:
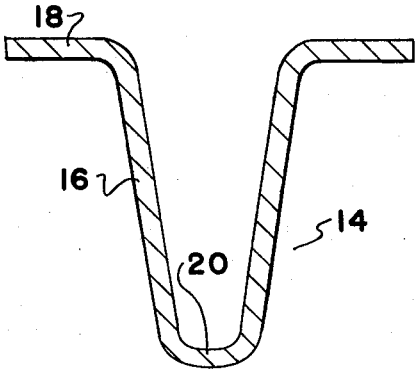
FIG. 4 is a transverse vertical sectional view of a runner of the article of FIG. 1 prior to assembly.
Figure 5:
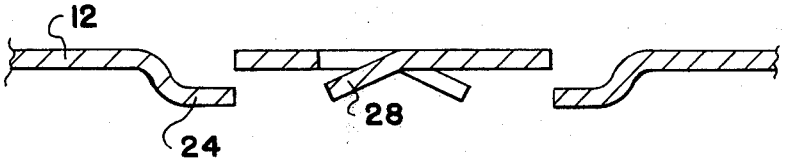
FIG. 5 is a transverse vertical sectional view of an exemplary portion of the deck of the article of FIG. 1 prior to assembly.

Fabrication of the presently preferred embodiment is relatively straight forward. The runners 14 are stamped from sheet metal and formed to final shape except that the corrugated surface portions of the flanges 18 are omitted. The deck 12 is also stamped from sheet metal and formed to final shape except that the corrugated surface portions of the brackets 24 are omitted. FIG. 4 shows a cross-section of a runner 14 and FIG. 5 shows a cross-section of an exemplary portion of the deck 12 at this point.

The pallet 10 is then assembled by sliding the runners 14 into place under the deck 12, the flanges 18 being engaged and guided by the brackets 24. Each flange 18 is then struck together with the associated bracket 24 so as to form the respective interlocking groove 22 and ridge 26.

The sheet material of the pallet 10 can be of any suitable metal and thickness depending upon the application.

For a better appreciation of the presently preferred embodiment reference is made to the following example:

EXAMPLE

A pallet 10 in accordance with the presently preferred embodiment was constructed from 0.170 inch thick sheet of 5086-H34 aluminum. The deck 12 had outside dimensions of 54 inches square and was provided with a 2 inch high centrally positioned circular flange having a diameter of about 19 inches, the circular flange being for centering and securing 12,000 pound spools of coiled metal sheet. A test was subsequently conducted wherein the pallet successfully withstood a load of 35,000 pounds. For a perspective view of the exemplary pallet 10, reference is made to FIG. 6.

The invention may have yet other practical embodiments. In FIG. 7, for example, there is shown a runner 14 wherein the flanges 18 depend inwardly from the sidewalls 16. Note also in FIG. 7 that the tabs 28 of the deck 12 are positioned outboard of the associated sidewalls 16. It will be recognized, however, that the provision of the grooves 22 and the ridges 24 of this embodiment may be less convenient than as previously discussed. It may for instance be necessary to further provide holes in the sidewalls 16 through which each bracket 24 may be supported before striking the associated flange 18 from above.

In another embodiment, as illustrated in FIG. 8, the laterally oriented surfaces of the flanges 18 and the brackets 24 are substantially flat. Tangential displacement of the runner 14 relative to the deck 12 is resisted by a vertically oriented surface portion of each bracket 24 in position against the lengthwise edge of the associated flange 18. Any tendency of the runner 14 to slide in its lengthwise direction relative to the deck 12 is resisted by friction. Conceivably such resistance could be further enhanced by gluing.

In still another embodiment, as shown in FIG. 9, the configuration is similar to that in FIG. 8 except that the vertically oriented surface portion of each bracket 24 envelopes the lengthwise edge of the associated flange 18.

In most applications of the invention it is contemplated that the pallet 10 have two runners 14. The runners 14 are ordinarily sufficiently spaced apart to permit the introduction of the fork of a truck therebetween and to provide acceptable stability to the overall structure. It is conceived however that support for the deck 12 may be externally provided in part, in which case only one runner 14 might suffice. Other applications might of course call for more than two runners 14.

As is well known in the art, the pallet 10 can be provided with various means for positioning and securing specific loads thereto. By way of example FIG. 6 shows one such method of practice.

While several embodiments of this invention have above been illustrated and described along with methods of practicing the same, it will be recognized that the invention may otherwise be embodied and practiced within the scope of the following claims:

What is claimed is:

1. A sheet metal pallet, which comprises:

a runner having a pair of integrally connected opposed sidewalls, each sidewall having a flange which depends laterally from the uppermost portion thereof, the flanges being in substantially coplanar relation; and a substantially planar deck having a set of brackets and a set of tabs, the runner being positioned against the underside of the deck with the flanges thereof and the underside of the deck in abutting relation, the set of brackets including a bracket for each flange, each bracket being displaced downwardly from the deck and integrally connected therewith, each bracket having a laterally oriented surface portion and a substantially vertically oriented surface portion, the laterally oriented surface portion being connected to the deck by the substantially vertically oriented surface portion, the laterally oriented surface portion being positioned immediately below the underside of the associated flange, whereby the set of brackets cooperates with the flanges to fix the runner to the deck, the set of tabs including a tab for each sidewall, each tab being displaced downwardly from the deck and integrally connected therewith, each tab having a lower edge in proximate contact with the associated sidewall, whereby the set of tabs cooperates with the sidewalls to substantially resist, relative to the deck, displacement of the runner when a torque is externally applied thereto.

2. The article of claim 1 wherein the substantially vertically oriented surface portion of each bracket is positioned against the lengthwise edge of the associated flange.

3. A sheet metal pallet which comprises:

a runner having a pair of integrally connected opposed sidewalls, each sidewall having a flange which depends laterally from the uppermost portion thereof, the flanges being in substantially coplanar relation, each flange having a corrugated surface portion which has a downwardly open groove; and a substantially planar deck having a set of brackets, the runner being positioned against the underside of the deck with the flanges thereof and the underside of the deck in abutting relation, the set of brackets including a bracket for each flange, each bracket being displaced downwardly from the deck and integrally connected therewith, whereby in the deck there is defined an opening above each bracket, each bracket having a corrugated surface portion which is positioned immediately below the associated flange and which has an upwardly protruding ridge corresponding to the groove of the associated flange, each ridge being in interlocking relationship with the corresponding groove, the top surface portion of each flange which overlies the central portion of each groove therein being extended upwardly into the opening in the deck from which the associated bracket is displaced, whereby the set of brackets cooperates with the flanges to fix the runner to the deck.

4. The article of claim 3 wherein the deck further has a set of tabs which includes a tab in cooperation with each sidewall of the runner, each tab being displaced downwardly from the deck and integrally connected therewith, each tab being located between the two sidewalls, each tab having a lower edge in proximate contact with the associated cooperating sidewall, whereby the set of tabs cooperates with the sidewalls to substantially resist, relative to the deck, displacement of the runner when a torque is externally applied thereto.

5. The article of claim 4, wherein the sidewalls of the runner are integrally connected by a curved bottom surface, the direction of curvature being concave upwardly and the degree of curvature being such that the bottom surface will become substantially flat when the deck is fully loaded.

* * * * *